US005530970A

United States Patent [19]

Knutson

[11] Patent Number: 5,530,970

[45] Date of Patent: Jul. 2, 1996

[54] COIL SPRING DISPLAY DEVICE

[76] Inventor: Kirby J. Knutson, 1915 Windsor Rd., Rockford, Ill. 61111

[21] Appl. No.: 283,655

[22] Filed: Aug. 1, 1994

Related U.S. Application Data

[63] Continuation of Ser. No. 99,613, Jul. 30, 1993, abandoned.

[51] Int. Cl.[6] ..... A42B 1/24

[52] U.S. Cl. ..... 2/209.13; 2/244; 40/329; 446/27; 446/486

[58] Field of Search ..... 2/185 R, 186, 2/199, 209.13, 244–246, 195.1; 40/315, 329, 409, 411, 586; 446/27, 268, 486; D21/66, 67, 68, 69, 70, 247

[56] References Cited

U.S. PATENT DOCUMENTS

| | | | |
|---|---|---|---|
| 22,645 | 7/1893 | Gutlohn | 24/708.7 |
| D. 156,442 | 12/1949 | Levine | 2/199 |
| 1,394,670 | 10/1921 | DaCosta | 446/486 |
| 2,464,665 | 3/1949 | Anderson | 446/268 |
| 2,611,902 | 9/1952 | Rockmore | 2/199 |
| 3,098,316 | 7/1963 | McCarthy | 446/27 |
| 3,104,644 | 9/1963 | Burton | 2/199 |
| 3,176,431 | 4/1965 | Richardson et al. | 446/486 |
| 3,213,823 | 10/1965 | Levy | 2/199 |
| 3,254,444 | 6/1966 | Paterson | 2/199 |

*Primary Examiner*—Diana Biefeld

*Attorney, Agent, or Firm*—Robert E. Browne; Mark R. Galis; Gary R. Jarosik

[57] ABSTRACT

A novel, flexible device which is attachable to a visor, baseball cap or like attire and which functions to display various logos, slogans, trademarks and other designs. The invention includes a spring or other flexible attachment means which can be attached to the top button, back, bill or strap of a cap and which supports a rigid display means bearing indicia such as a logo, slogan, trademark or other design.

1 Claim, 3 Drawing Sheets

COIL SPRING DISPLAY DEVICE

This is a continuation of application Ser. No. 08/099,613, filed Feb. 7, 1993, now abandoned.

BACKGROUND OF THE INVENTION

The invention disclosed herein relates to novelty items of the type which wiggle or move to attract attention. Specifically, this invention relates to a novel, flexible device which is attachable to a visor, baseball cap or like attire and which functions to display various logos, slogans, trademarks and other designs. The invention includes a spring or other flexible attachment means which can be attached to the top button, back, bill or strap of a cap and which supports a rigid display means bearing indicia such as a logo, slogan, trademark or other design. The rigid display means will thus be flexibly attached to the baseball cap and will move or wiggle as the head of the wearer is moved so as to attract attention. The degree of "wiggling" of the rigid display means will depend on the length and stiffness of the spring or other flexible attachment means.

SUMMARY OF THE INVENTION

This invention comprises a flexible display preferably formed from a tapered coil spring and a rigid piece of cardboard or plastic. In the preferred embodiment, a flexible structure is formed by fitting or attaching a piece of rigid plastic or cardboard securely into the tapered end of a coil spring so that it does not fall out or dislodge when the spring flexes or wiggles. The larger, opposite or base end of the tapered spring is then fit securely around the button on the top of a baseball cap by securing this larger end of the tapered spring over the button. The base end of the tapered spring may also be clipped over the bill or strap of a cap or visor by spreading adjacent coils of the spring on opposite sides of the bill or strap.

The resulting structure is flexible so that the logo, design, slogan, trademark or other design imprinted on or attached to the plastic or cardboard display means moves in various directions as the head of the wearer of the cap moves in opposite directions. The display thereby appears to "bounce" along attracting peoples' attention. The degree of movement of the display means increases or decreases depending on the movements of the person wearing the flexible display. Other flexible attachment means, such as suitable plastics and rubbers may be substituted for the spring. In addition, as shown in the drawings, the flexible attachment means may also be attached to the bill, strap and back of a baseball cap, visor or similar mounting means. This invention will be described in more detail in connection with the drawings as follows.

DETAILED DESCRIPTION OF THE INVENTION

Figure 1:
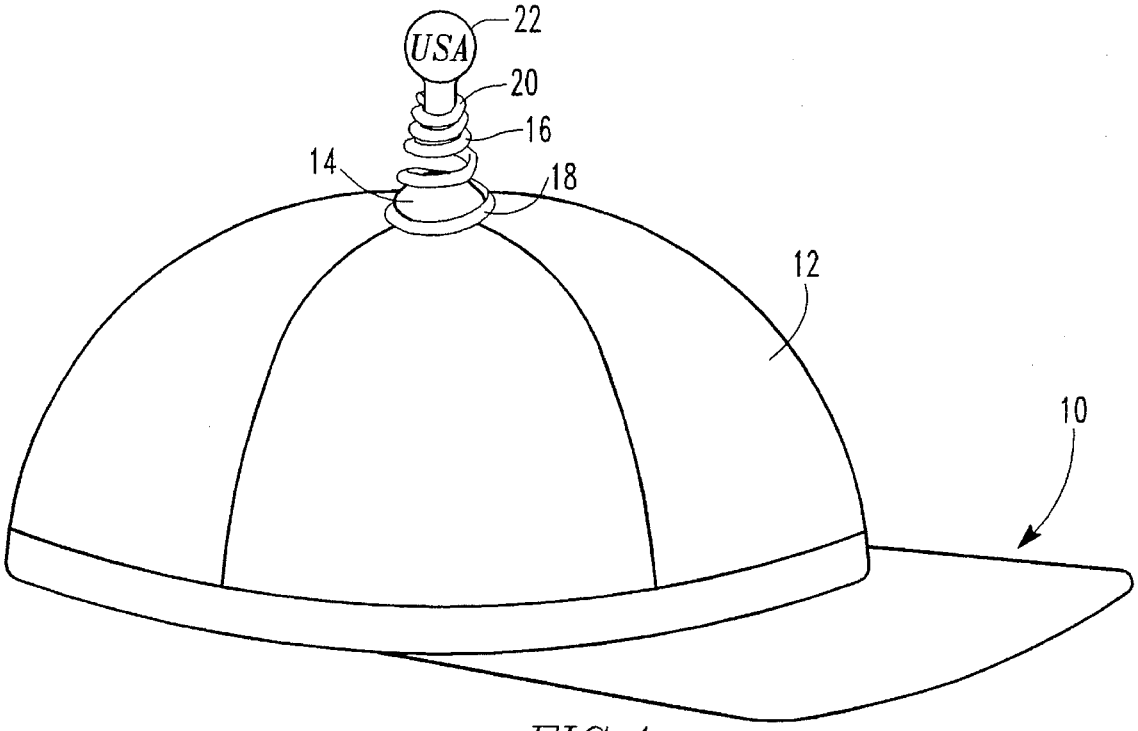
FIG. 1 is perspective view of all the components of a first embodiment of the flexible display.
Figure 2:
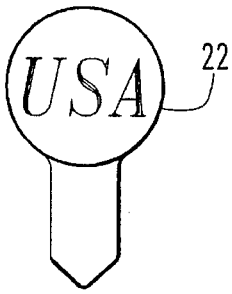
FIG. 2 is a front view of the display means.

Referring to FIG. 1, a perspective view of all the components of a preferred embodiment of the flexible display 10 is shown. FIG. 1 shows a baseball cap 12 having a button 14 on top thereof. A flexible attachment means consisting of a tapered spring 16 is mounted onto said button 14. This is accomplished by having the circumference of the base or bottom end 18 of said spring 16 be of approximately the same or slightly smaller inside diameter than the diameter of said button 14. The spring 16 because of its resilience may be expanded to screw over said button 14. The bottom end 18 of said spring 16 returns to its original dimension beneath said button 14 to "lock" said flexible display 10 in place. Said base or bottom end 18 which screws on said button 14 is larger than the upper, tapered end 20 of said spring 16. A display means for bearing indicia 22 such as a cardboard or plastic display, as shown in FIG. 2, fits securely into said tapered end 20 of said spring 16 so that it will not fall out of dislodge when said spring 16 wiggles or flexes. The tapering of said spring 16 encourages flexing because the larger mass of the display means 22 at the top of said spring 16 tends to bend said spring 16 like a fishing rod or similar structure in response to slight linear or angular movements of the spring base or bottom end 18.

Figure 3:
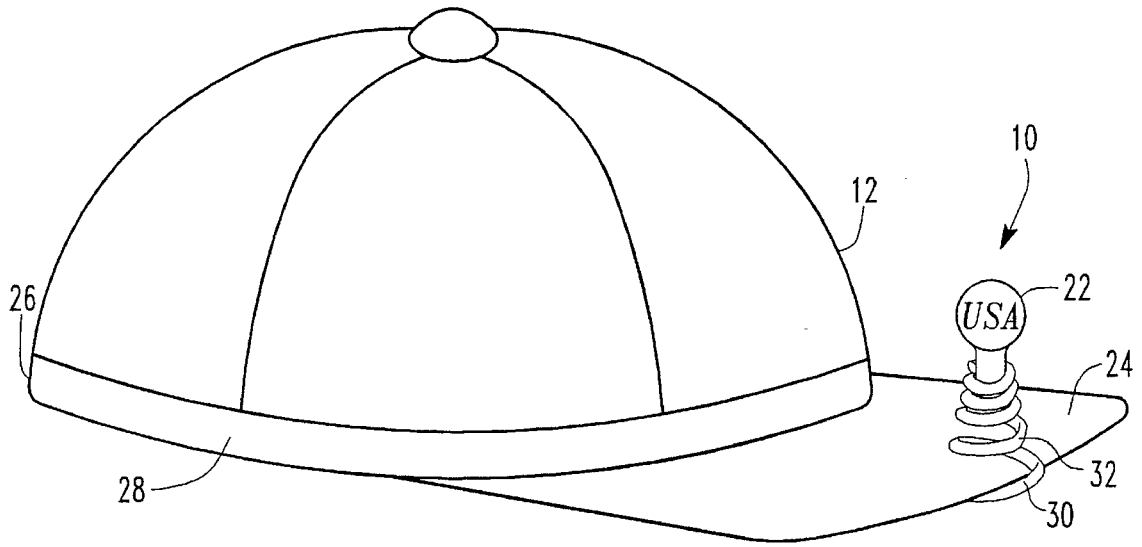
FIG. 3 is a perspective view of all the components of a second embodiment of the flexible display.
Figure 4:
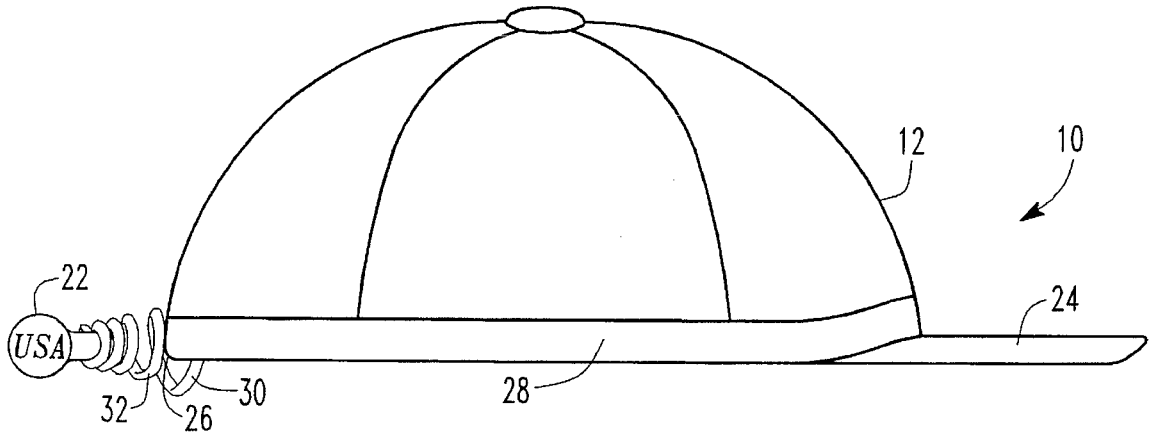
FIG. 4 is a perspective view of all the components of a third embodiment of the flexible display.
Figure 5:
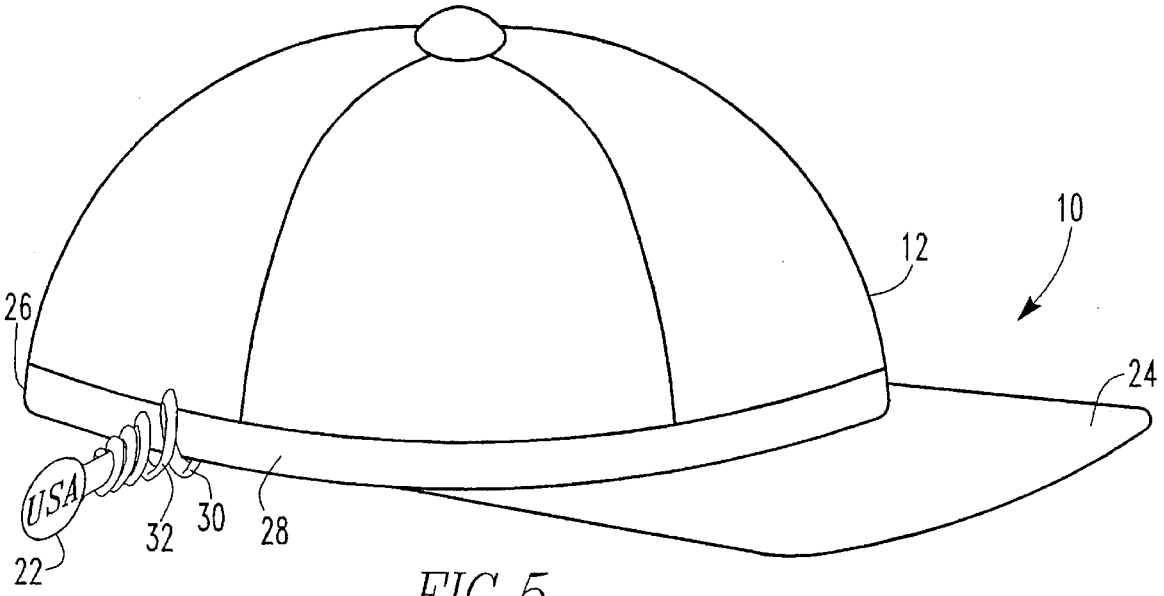
FIG. 5 is a perspective view of all the components of a forth embodiment of the flexible display.

Referring to FIGS. 3 through 5, alternative embodiments of the flexible display 10 are shown. In these embodiments, the base or bottom end 18 of said spring 16 which can be placed over said button 14 is attached to the bill 24, back 26, or strap 28 of said cap 12. Said spring 16 is attached to said bill 24, back 26, or strap 28, of said cap 12 by inserting said bill 24, back 26, or strap 28 of said cap 12 between adjacent coils 30 and 32 of spring 16. Again, the resilient memory of the spring 16 causes it to clamp the material of the bill 24, back 26, or strap 28 to maintain its position.

It is understood that the above descriptions of the invention are not intended to limit the invention in any way. This invention should be read as limited by the claims only.

I claim:

1. A display device removably attachable to an article of clothing, comprising:

a coil spring having a lower end and an upper end, said lower end of said coil spring comprising a pair of generally circular, resilient sections disposed in proximity to one another and adapted to releasably secure a portion of said article of clothing therebetween, said upper end of said coil spring comprising a generally circular section having an opening therethrough; and a display having a visible display surface and a generally tapered, lower end, said lower end of said display adapted to be insertable into said opening of said upper end of said coil spring for maintaining said display therein;

wherein said coil spring is tapered such that the diameter of said lower end of said coil spring is larger that the diameter of said upper end of said coil spring.

* * * * *